US008544975B2

(12) United States Patent
Lee

(10) Patent No.: US 8,544,975 B2
(45) Date of Patent: Oct. 1, 2013

(54) INKJET IMAGE FORMING APPARATUS AND METHOD TO CONTROL THE SAME

(75) Inventor: Ho Keun Lee, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1553 days.

(21) Appl. No.: 12/060,400

(22) Filed: Apr. 1, 2008

(65) Prior Publication Data

US 2009/0033703 A1 Feb. 5, 2009

(30) Foreign Application Priority Data

Aug. 2, 2007 (KR) ..... 10-2007-0077748

(51) Int. Cl.
*B41J 29/38* (2006.01)

(52) U.S. Cl.
USPC ..... 347/14; 347/10; 347/11; 347/12; 347/13; 347/15

(58) Field of Classification Search
USPC ..... 347/10–15
See application file for complete search history.

(56) References Cited

U.S. PATENT DOCUMENTS 6,390,583 B1 * 5/2002 Kato et al. ..... 347/15
6,644,772 B2 * 11/2003 Choi ..... 347/19
7,014,374 B2 * 3/2006 Hamaguchi et al. ..... 400/62
7,125,114 B2 * 10/2006 Tsujimoto ..... 347/105
2002/0158933 A1 * 10/2002 Yamamoto ..... 347/15
2003/0007024 A1 * 1/2003 Fujimori ..... 347/15
2003/0053093 A1 * 3/2003 Eom ..... 358/1.9
2003/0107611 A1 * 6/2003 Kim ..... 347/12
2003/0179256 A1 * 9/2003 Endo ..... 347/19
2004/0080555 A1 * 4/2004 Otsuki et al. ..... 347/14
2005/0024406 A1 * 2/2005 Otsuki ..... 347/14
2006/0164453 A1 * 7/2006 Silverbrook et al. ..... 347/13
2006/0279598 A1 * 12/2006 Kim et al. ..... 347/19
2007/0008355 A1 * 1/2007 Miyamoto et al. ..... 347/9
2007/0046706 A1 * 3/2007 Kayahara et al. ..... 347/14
2007/0126768 A1 * 6/2007 Silverbrook et al. ..... 347/10
2008/0036812 A1 * 2/2008 Kakutani ..... 347/15

FOREIGN PATENT DOCUMENTS

JP 2004-106529 4/2004

* cited by examiner

*Primary Examiner* — Ryan Lepisto
*Assistant Examiner* — Guy Anderson
(74) *Attorney, Agent, or Firm* — Stanzione & Kim, LLP

(57) ABSTRACT

An inkjet image forming apparatus and a method to control the same to correct characteristics of a plurality of print heads of the apparatus to have uniform characteristics includes a plurality of test patterns printed according to the timing of printing of dots through a row of odd nozzles and a row of even nozzles of each of the plurality of print heads and information of the drive timing corresponding to a brightest test pattern of the printed test patterns is stored. When a normal print operation is performed, a different drive timing is applied to each of the plurality of print heads based on the stored information, thereby compensating for the difference between the one or more characteristics of the print heads.

11 Claims, 19 Drawing Sheets

FIG. 9

400

| PRINT HEAD NUMBER | BRIGHTEST PATTERN NUMBER | PRINT HEAD NUMBER | BRIGHTEST PATTERN NUMBER |
|---|---|---|---|
| Head #1 | 0 | Head #8 | 0 |
| Head #2 | 0 | Head #9 | 0 |
| Head #3 | 0 | Head #10 | 0 |
| Head #4 | 1 | Head #11 | 0 |
| Head #5 | 0 | Head #12 | 0 |
| Head #6 | 0 | Head #13 | 1 |
| Head #7 | -1 | Head #14 | -2 |

INKJET IMAGE FORMING APPARATUS AND METHOD TO CONTROL THE SAME

CROSS-REFERENCE TO RELATED APPLICATIONS

This application claims priority under 35 U.S.C. §119(a) from Korean Patent Application No. 2007-0077748, filed on Aug. 2, 2007 in the Korean Intellectual Property Office, the disclosure of which is incorporated herein in its entirety by reference

BACKGROUND OF THE INVENTION

1. Field of the Invention

The present general inventive concept relates to an inkjet image forming apparatus to compensate for the difference between characteristics of print heads, each including a plurality of nozzles, and a method to control the same.

2. Description of the Related Art

An image forming apparatus such as an inkjet printer generally jets droplets of printing ink to desired positions on a print medium such as a sheet of paper or fabric to form images in desired colors on a surface of the print medium.

Conventional inkjet printers have an ink cartridge which prints an image on a print medium (for example a sheet of paper) while reciprocating in a transverse direction of the sheet of paper, which is perpendicular to a conveyance direction of the sheet of paper. However, these conventional inkjet printers with the ink cartridge have a low printing speed.

A recently developed inkjet printer includes an inkjet cartridge having a plurality of print heads arranged over an entire width of a sheet of paper to print an image at a high speed without reciprocating the ink cartridge. This inkjet printer is referred to as a print head array inkjet printer.

An ink cartridge of the conventional print head array type includes a plurality of ink tanks that store printing ink, a plurality of negative pressure controllers connected respectively to the plurality of ink tanks, a plurality of print heads arranged in a regular pattern along the transverse direction of a print medium, and an ink channel unit to supply ink from the plurality of ink tanks to the plurality of print heads.

This inkjet printer generally employs a method in which a row of odd nozzles and a row of even nozzles provided on each print head alternately jet ink in order to print a line of an image. In this method, the row of even nozzles jet ink when the print head has been moved a specific distance after the row of odd nozzles jet ink. Alternatively, the rows of odd and even nozzles may jet ink in an opposite order. To accomplish this, the printer controls the ink jet timing of each nozzle. However, the print heads can be manufactured at low costs since a row of odd nozzles and a row of even nozzles can be formed at sufficient intervals on each print head, compared to when nozzles are arranged in a line.

When rows of odd nozzles and rows of even nozzles are used to print lines of an image, straightness of each printed line greatly affects quality of the printed image. A general method to determine conditions of nozzles of a print head is to experimentally print a line and then to check a state of the printed line such as the straightness thereof.

Recently, resolution of images printed by an image forming apparatus has been significantly increased. A performance of print heads of the image forming apparatus by viewing the states of printed lines can be roughly estimated. However, accurately determining the characteristics of the print heads by viewing the printed lines is difficult since the printed lines are very thin and narrow to satisfy the high resolution requirement. The estimation of the characteristics of the print heads may also vary depending on individual recognition and determination capability.

Although a plurality of print heads of an image forming apparatus have uniform characteristics when the product is shipped, the characteristics of the print heads may become different by unintended causes or when the user or service engineer has repaired the print heads or has replaced and mounted at least one print head. In this case, elimination of the difference between the characteristics of the plurality of print heads to have uniform characteristics is necessary.

SUMMARY OF THE INVENTION

The present general inventive concept provides an inkjet image forming apparatus and a method to control the same to eliminate a difference between characteristics of a plurality of print heads of the apparatus to have uniform characteristics.

The present general inventive concept also provides an inkjet image forming apparatus and a method to control the same, wherein a plurality of test patterns are printed according to a timing of printing of dots through a row of odd nozzles and a row of even nozzles of each of a plurality of print heads, thereby easily and correctly recognizing a difference between characteristics of the plurality of print heads.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet image forming apparatus including a print head including a plurality of nozzles, a memory to store control information of the print head, and a controller to obtain a brightness level information of a print result printed on the basis of the stored control information, and to correct one or more of the stored control information based on the obtained brightness level information.

A plurality of colors can be printed using the plurality of nozzles and the controller alternately drives a row of odd nozzles and a row of even nozzles to print one of the colors on a line by line basis.

The stored control information can be used to test a drive timing of a plurality of nozzles included in at least one of the rows of odd and even nozzles of the print head.

The memory can store information used to correct the drive timing based on a test result of the plurality of nozzles of the print head.

The controller can receive the brightness level information through the user interface.

The foregoing and/or other aspects and utilities of the present general inventive concept may also be achieved by providing an inkjet image forming apparatus including a plurality of print heads arranged along a transverse direction of a print medium, and a controller to apply a different drive timing of nozzles to jet ink to each of the plurality of print heads in order to form a line when at least one color is printed on the print medium on a line by line basis.

The controller can apply a drive timing to provide a brightest printing, among a plurality of drive timings to each of the plurality of print heads.

The inkjet image forming apparatus may further include a user interface to receive information of a drive timing providing the brightest printing for each of the plurality of print heads.

Information identifying a brightest test pattern among a plurality of test patterns printed for each of the plurality of print heads is received through the user interface.

The foregoing and/or other aspects and utilities of the present general inventive concept may also be achieved by providing an inkjet image forming apparatus including a plurality of print heads arranged along a transverse direction of a print medium, a memory to store information of a drive timing of a plurality of nozzles, corresponding to a time to jet ink, for each of the plurality of print heads, and a controller to control an operation of each of the plurality of print heads to print a plurality of test patterns using the information stored in the memory and to receive information of a drive timing corresponding to a brightest test pattern among the plurality of test patterns from the memory and to apply the received drive timing information to a normal print operation.

The inkjet image forming apparatus may further include a user interface to provide information of a drive timing corresponding to the brightest test pattern of the plurality of test patterns.

When a row of odd nozzles and a row of even nozzles are alternately driven, the information of the drive timing of the plurality of nozzles may include a difference between a time to drive the row of odd nozzles and a time to drive the row of even nozzles.

The foregoing and/or other aspects and utilities of the present general inventive concept may also be achieved by providing a method to control an inkjet image forming apparatus to perform printing using a plurality of print heads, the method including printing a plurality of test patterns for each of the plurality of print heads, storing information of a drive timing corresponding to a brightest test pattern among the plurality of test patterns printed for each of the plurality of print heads, and performing a print operation by applying a different drive timing to each of the plurality of print heads using the stored information.

A pattern number identifying the brightest test pattern can be input through a user interface and information of a drive timing can be stored based on the input pattern number.

Printing the plurality of test patterns may include printing dots through a row of odd nozzles and dots through a row of even nozzles for each of the plurality of test patterns such that the dots printed through the row of odd nozzles are not aligned with the dots printed through the row of even nozzles to a different extent of misalignment according to the test pattern.

The foregoing and/or other aspects and utilities of the present general inventive concept may also be achieved by providing a method to control an inkjet image forming apparatus to perform printing using a plurality of print heads, the method including performing test printing to test characteristics of each of the plurality of print heads, storing information of a drive timing applied to each of the plurality of print heads based on a result of the test printing to allow an image printed using each of the plurality of print heads to have uniform brightness, and performing, when receiving a print command, a print operation by applying a different drive timing to each of the plurality of print heads using the stored information.

When a row of odd nozzles and a row of even nozzles provided in each of the plurality of print heads are alternately driven to print a line, a difference between a time to drive the row of odd nozzles and a time to drive the row of even nozzles can be set as information of the drive timing applied to each of the plurality of print heads.

The foregoing and/or other aspects and utilities of the general inventive concept may also be achieved by providing an inkjet image forming apparatus having a test printing mode and a normal printing mode, the apparatus including one or more print heads having a plurality of nozzles to print a plurality of test patterns in the test printing mode, a memory to store a first set of information to be used to print the test patterns and a second set of information corresponding to a comparison of the test patterns, and a controller to control the one or more print heads to print the plurality of test patterns based on the first set of information and to apply the second set of information in the normal printing mode to correct a characteristic of the one or more print heads.

The second set of information may correspond to a drive timing of the plurality of nozzles of at least one test pattern.

The second set of information may include information based on a brightest test pattern.

The foregoing and/or other aspects and utilities of the general inventive concept may also be achieved by providing computer-readable recording medium having embodied thereon a computer program to execute a method, wherein the method includes printing a plurality of test patterns in a test printing mode with one or more print heads, storing a first set of information to be used to print the test patterns and a second set of information corresponding to a comparison of the test patterns, controlling the one or more print heads to print the plurality of test patterns based on the first set of information and applying the second set of information in a normal printing mode to correct a characteristic of the one or more print heads.

BRIEF DESCRIPTION OF THE DRAWINGS

These and/or other aspects utilities of the present general inventive concept will become apparent and more readily appreciated from the following description of the embodiments, taken in conjunction with the accompanying drawings of which:

FIG. 9 is an example screen to allow a user to enter a pattern number corresponding to a brightest test pattern of each of the plurality of print heads through a user interface according to an embodiment of the present general inventive concept.

DETAILED DESCRIPTION OF THE PREFERRED EMBODIMENTS

Figure 1A:
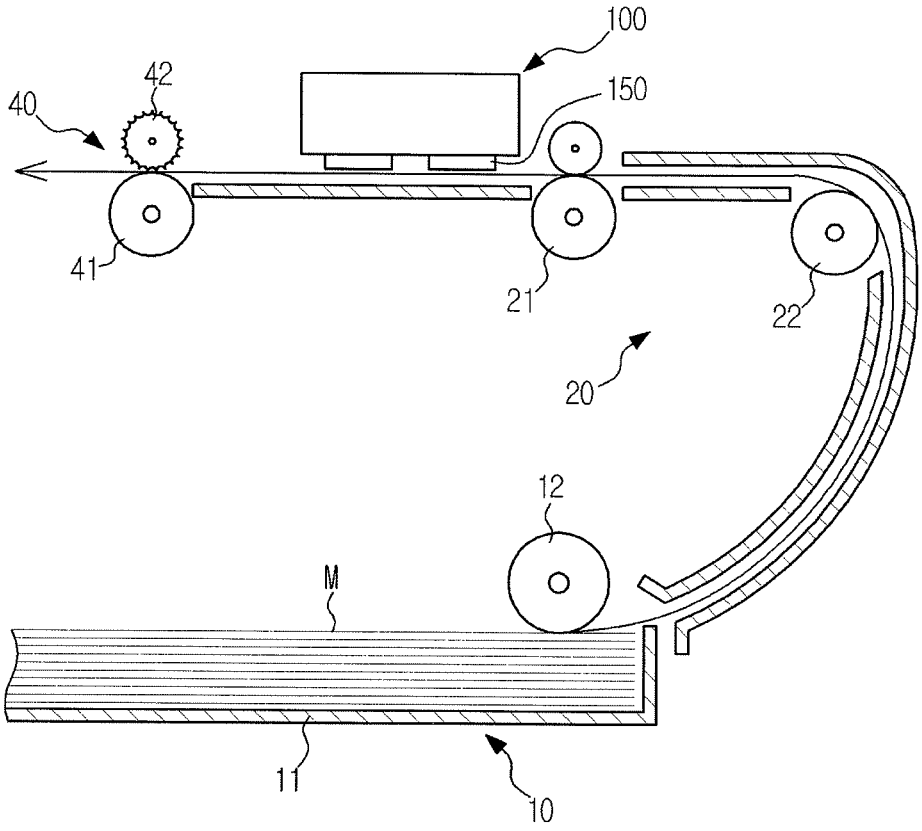
FIG. 1A illustrates a schematic configuration of an inkjet image forming apparatus according to an embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1A, an inkjet image forming apparatus according to an embodiment of the present general inventive concept includes a medium feed unit 10 to feed a print medium M, a conveyor unit 20 to convey the print medium M, a plurality of print heads 150 to form an image on the print medium conveyed by the conveyor unit 20, an ink supply unit 100 to supply ink to the print heads 150, and a medium eject unit 40 to eject the printed print medium out of the image forming apparatus.

The medium feed unit 10 includes a medium tray 11 in which print media M are stacked and a pickup roller 12 to pick up the print media stacked in the medium tray 11 one by one. The conveyor unit 20 conveys the print medium picked up by the pickup roller 12 below the plurality of print heads 150. The conveyor unit 20 may include a feeding roller 21 mounted at an entrance side of the plurality of print heads 150 and an auxiliary roller 22 mounted between the feeding roller 21 and the pickup roller 12.

The medium eject unit 40 may include an eject roller 41 mounted downstream of the print heads 150 in a conveyance direction of the print medium M and a star wheel 42 mounted opposite the eject roller 41.

Figure 1B:
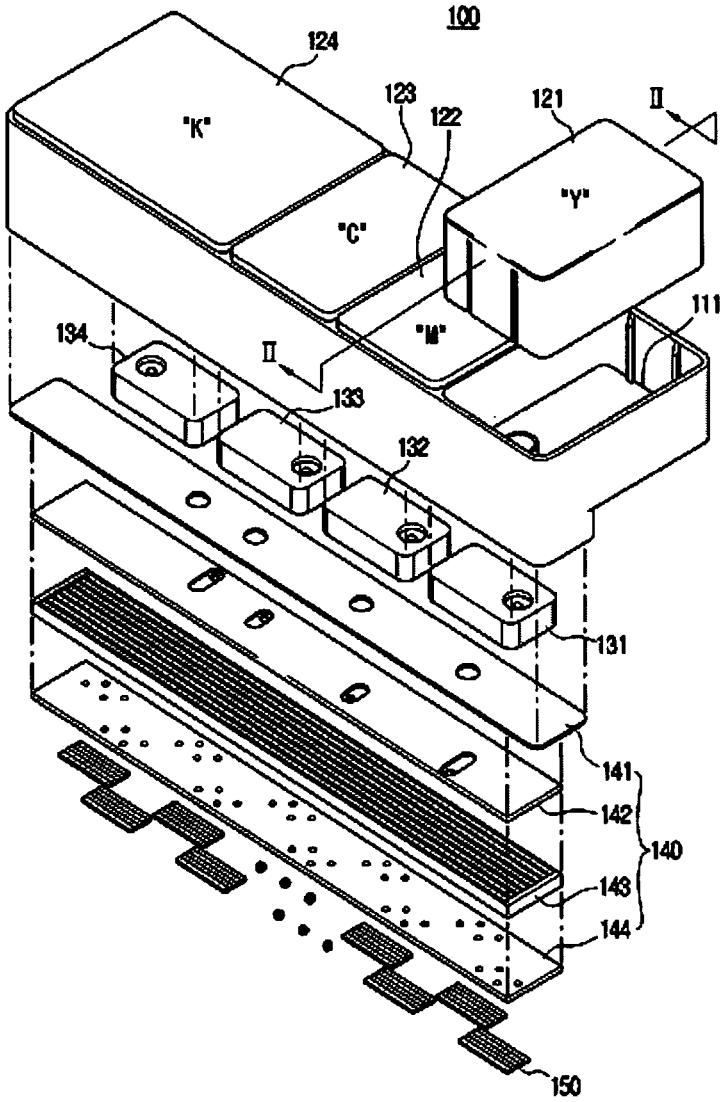
FIG. 1B is an exploded perspective view illustrating an ink supply unit applied to the inkjet image forming apparatus according to the embodiment as illustrated in FIG. 1A.

As illustrated in FIG. 1B, the plurality of print heads 150 mounted on the ink supply unit 100 are arranged over an entire width of a print medium (for example, a sheet of paper).

The ink supply unit 100 includes a plurality of ink tanks 121, 122, 123, and 124 in which printing ink is stored, a plurality of negative pressure controllers 131, 132, 133, and 134 connected respectively to the plurality of ink tanks 121, 122, 123, and 124, a plurality of print heads 150 arranged in a specific pattern along the transverse direction of the print medium, and an ink channel unit 140 to supply ink from the plurality of ink tanks 121, 122, 123, and 124 to the plurality of print heads 150.

The plurality of ink tanks 121, 122, 123, and 124 are mounted in a frame 110. The ink tanks 121, 122, 123, and 124 store ink of various colors, for example, yellow, magenta, cyan, and black inks, respectively.

A tank mount 111 is provided in the frame 110 to mount the ink tanks 121, 122, 123, and 124 in the tank mount 111.

The plurality of negative pressure controllers 131, 132, 133, and 134 are mounted under the frame 110 such that they communicate respectively with the plurality of ink tanks 121, 122, 123, and 124. Each of the plurality of negative pressure controllers 131, 132, 133, and 134 functions to generate a negative pressure to prevent ink leakage.

The ink channel unit 140 is connected to the negative pressure controllers 131, 132, 133, and 134 and functions to supply ink received from the ink tanks 121, 122, 123, and 124 through the negative pressure controllers 131, 132, 133, and 134 to the plurality of print heads 150, respectively.

Figure 1C:
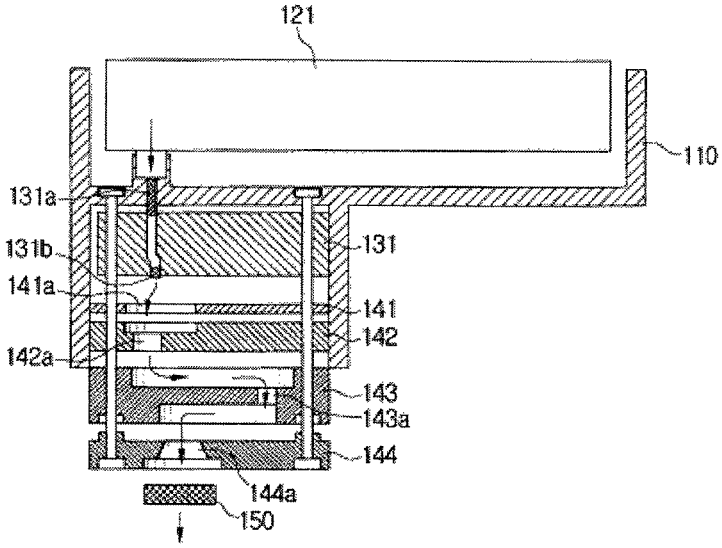
FIG. 1C is a cross-sectional view taken along a line II-II of FIG. 1B.

The ink channel unit 140 is manufactured by combining a plurality of channel plates 141, 142, 143, and 144 into a stack of channel plates. Among the plurality of channel plates 141, 142, 143, and 144, the channel plate 141 connected to the negative pressure controllers 131, 132, 133, and 134 may be a pressing plate. For example, the ink channel unit 140 may be constructed by sequentially stacking the three channel plates 142, 143, and 144 (i.e., the first channel plate 142, the second channel plate 143, and the third channel plate 144) on the pressing plate 141 as illustrated in FIG. 1C. The ink channel unit 140 may not include the pressing plate 141. The ink channel unit 140 may also include two, four, or more channel plates.

Each of the channel plates 141, 142, 143, and 144 has channels 141*a*, 142*a*, 143*a*, and 144*a* through which ink passes. The channels 141*a*, 142*a*, 143*a*, and 144*a* are arranged in the channel plates 141, 142, 143, and 144 such that channels of a same color communicate with each other.

Figure 1D:
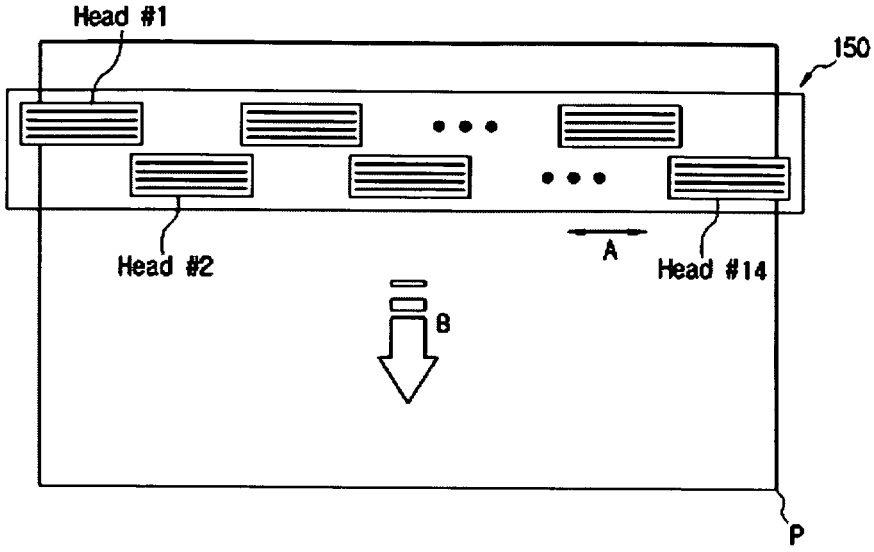
FIG. 1D illustrates an arrangement of a plurality of print heads.

As illustrated in FIG. 1D, the plurality of print heads 150 are arranged such that neighboring print heads overlap each other by a specific interval along a transverse direction A of a sheet of paper. This overlapping arrangement of the print heads (Head #1-Head #14), in which neighboring print heads overlap each other by a specific interval along the transverse direction A, prevents discontinuous printing of an image on the sheet of paper P along the transverse direction A when the paper P is being conveyed in a conveyance direction B.

Referring to FIG. 1B, although this embodiment employs a structure in which the ink supply unit 100 is integrated with the plurality of print heads 150 into a cartridge, the ink supply unit 100 may also be provided in a separate set from the plurality of print heads 150.

Figure 1E:
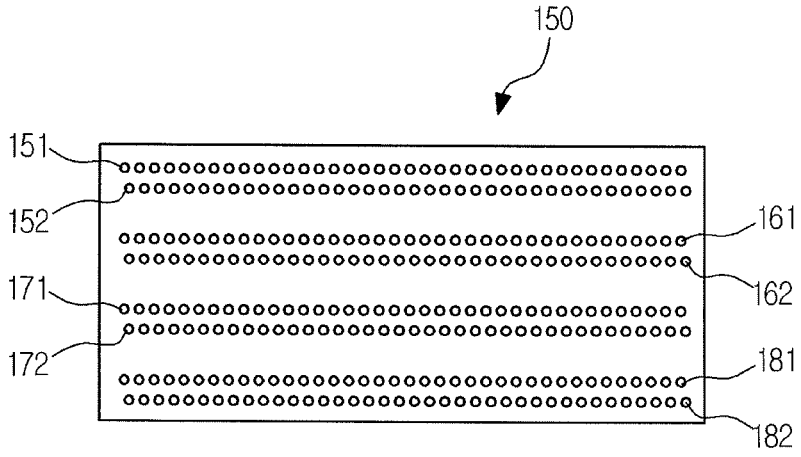
FIG. 1E illustrates an array of nozzles of various colors provided in a print head according to an embodiment of the present general inventive concept.

As illustrated in FIG. 1E, each of the plurality of print heads 150 includes a row of odd nozzles and a row of even nozzles that are arranged in parallel at upper and lower portions, respectively, along the transverse direction A of a sheet of paper for each of various colors. For example, a first row of nozzles 151 and a second row of nozzles 152 are provided to jet cyan ink, a third row of nozzles 161 and a fourth row of nozzles 162 are provided to jet magenta ink, a fifth row of nozzles 171 and a sixth row of nozzles 172 are provided to jet yellow ink, and a seventh row of nozzles 181 and an eighth row of nozzles 182 are provided to jet black ink.

As illustrated in FIG. 1E, the interval between each row of odd nozzles and the interval between each row of even nozzles are constant. The first of each row of even nozzles is located below an empty portion between the first and second of each row of odd nozzles. Thus, each row of odd nozzles and each row of even nozzles are arranged such that the odd nozzles are not aligned with the even nozzles by a specific interval.

An image is printed on a print medium on a line by line basis and a print speed corresponds to a number of lines of an image printed per unit time. Drive timings of nozzles to control ink jet timings of nozzles are set according to the print speed of the apparatus.

Drive timings of each print head are controlled such that a plurality of rows of nozzles jet ink to form a line of an image, starting from one of the plurality of rows, and a row of even nozzles jet ink to a print medium (a sheet of paper), for example when empty portions between dots printed at regular intervals by a row of odd nozzles are located immediately below the row of even nozzles as the print medium moves after the dots are printed on the print medium using the row of odd nozzles.

Figure 2:
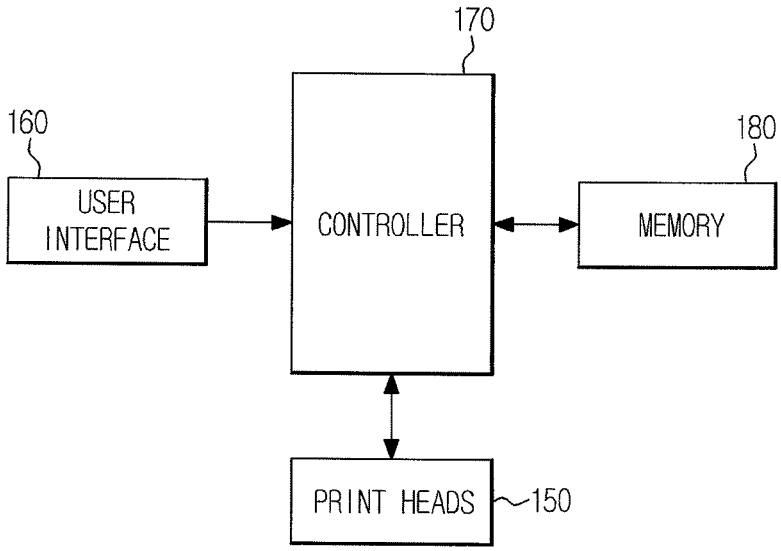
FIG. 2 is a block diagram illustrating an inkjet image forming apparatus according to an embodiment of the present general inventive concept.
Figure 3A:
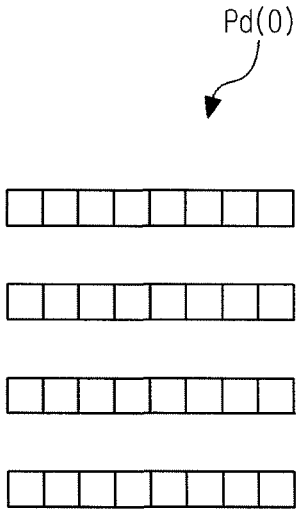
FIG. 3A illustrates a first test pattern to test characteristics of a print head according to an embodiment of the present general inventive concept.
Figure 3B:
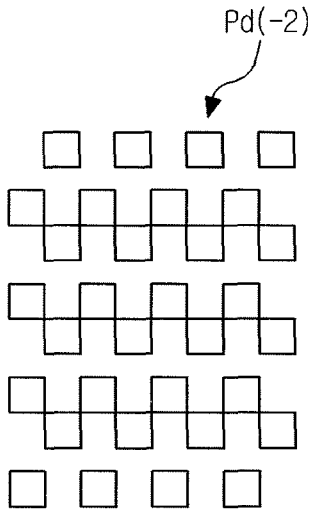
FIG. 3B illustrates a second test pattern to test characteristics of a print head according to an embodiment of the present general inventive concept.
Figure 3C:
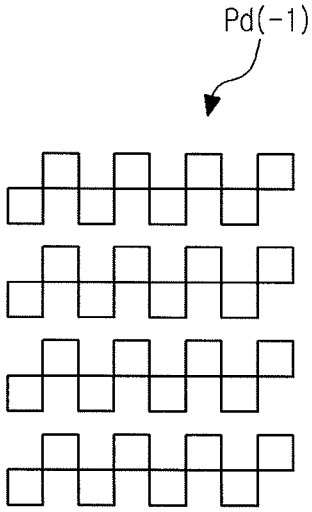
FIG. 3C illustrates a third test pattern to test characteristics of a print head according to an embodiment of the present general inventive concept.
Figure 3D:
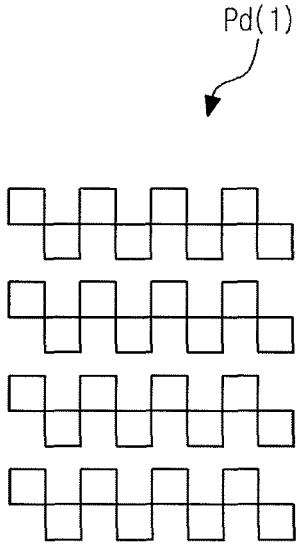
FIG. 3D illustrates a fourth test pattern to test characteristics of a print head according to an embodiment of the present general inventive concept.
Figure 3E:
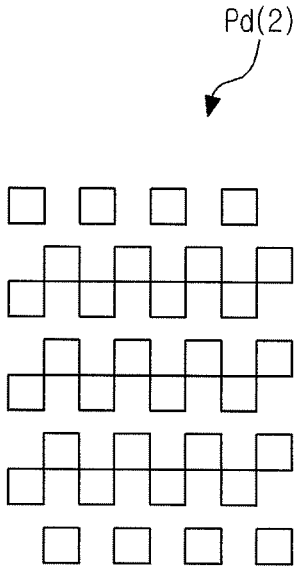
FIG. 3E illustrates a fifth test pattern to test characteristics of a print head according to an embodiment of the present general inventive concept.

As illustrated in FIG. 2, a controller 170 controls an operation to print image data stored in a memory 180 on a print medium in response to a user input command received through a user interface 160. To accomplish this, the controller 170 controls drive timings of the plurality of nozzles of each of the plurality of print heads 150.

Although a plurality of print heads 150 of an inkjet image forming apparatus have uniform characteristics when the product is shipped, the characteristics of the print heads 150 may become different by unintended causes or when the user or service engineer has repaired the print heads or has replaced and mounted at least one print head. In this case, the controller 170 prints a plurality of test patterns on a print medium by controlling the plurality of print heads 150 according to pattern information, used to determine head characteristics, stored in the memory 180.

In this embodiment, the pattern information used to determine head characteristics include, for example, drive timings of nozzles to reproduce first to fifth test patterns illustrated in FIGS. 3A-3E. In this example, ink of one color is used for the first to fifth test patterns and ink jetted from one nozzle forms one dot and each dot is illustrated as a rectangle in FIGS. 3A-3E for the sake of convenience.

The first test pattern Pd(0) is to print one line every three lines using a plurality of nozzles, where the dot formation timings of rows of odd and even nozzles are set so as to form one line.

The second test pattern Pd(−2) is to print two lines every three lines using a plurality of nozzles, where the dot formation timings of rows of even nozzles are set to be two lines earlier than those of rows of odd nozzles.

The third test pattern Pd(−1) is similar to the second test pattern Pd(−2) in that two lines are printed every three lines using a plurality of nozzles. However, in the third test pattern Pd(−1), the dot formation timings of rows of even nozzles are set to be one line earlier than those of rows of odd nozzles.

The fourth test pattern Pd(1) is similar to the second test pattern Pd(−2) in that two lines are printed every three lines using a plurality of nozzles. However, in the fourth test pattern Pd(1), the dot formation timings of rows of even nozzles are set to be one line later than those of rows of odd nozzles.

The fifth test pattern Pd(2) is similar to the second test pattern Pd(−2) in that two lines are printed every three lines using a plurality of nozzles. However, in the fifth test pattern Pd(2), the dot formation timings of rows of even nozzles are set to be two lines later than those of rows of odd nozzles.

The first to fifth test patterns illustrated in FIGS. 3A-3E can be correctly reproduced if a possibility exists to appropriately control the ink jet timings of rows of odd and even nozzles in the case where the characteristics of the print heads 150 are good.

Figure 4A:
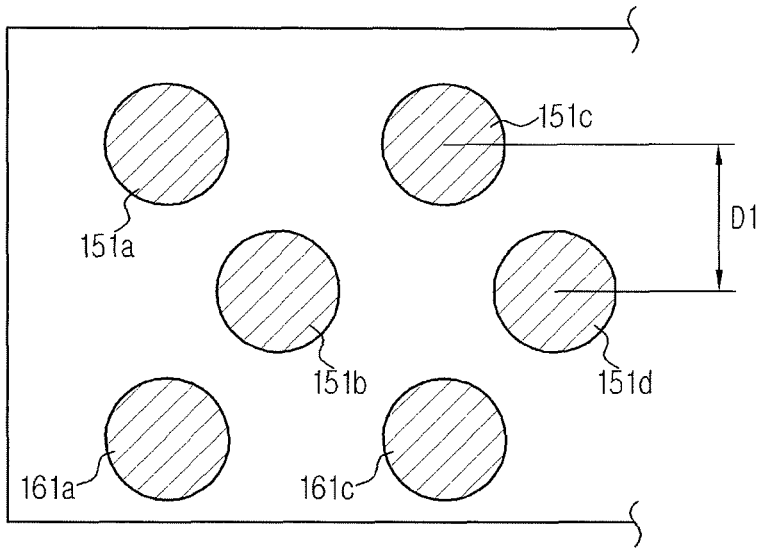
FIG. 4A illustrates an example where dots of an odd row and dots of an even row are printed at correct positions when the fourth test pattern is printed according to an embodiment of the present general inventive concept.

For example, when a print head is driven to print an image corresponding to the fourth test pattern, the interval between a plurality of dots 151*a* and 151*c* corresponding to a row of odd nozzles and a plurality of dots 151*b* and 151*d* corresponding to a row of even nozzles is a reference interval D1 if the timings of formation of the plurality of dots 151*b* and 151*d* of the even row are exactly one line later than the timings of formation of the plurality of dots 151*a* and 151*c* of the odd row as illustrated in FIG. 4A.

Figure 4B:
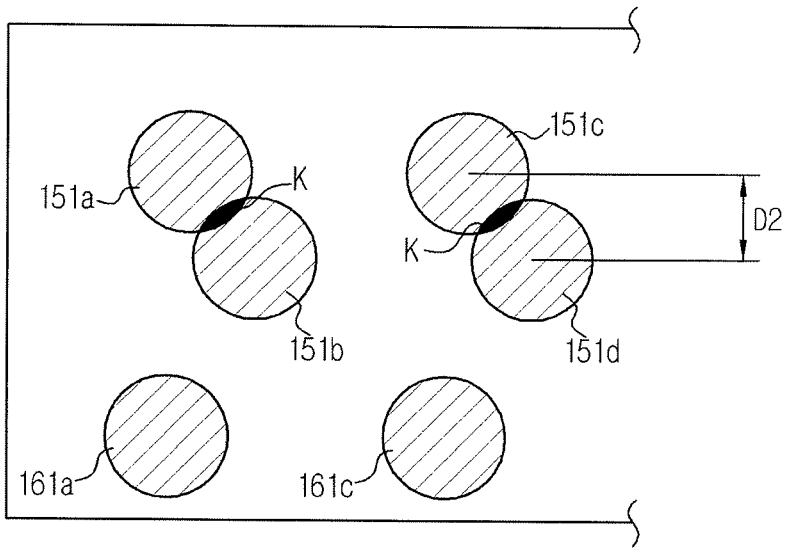
FIG. 4B illustrates an example where dots of an odd row and dots of an even row are printed at incorrect positions when the fourth test pattern is printed according to an embodiment of the present general inventive concept.

In another example, when a print head has been driven to print an image corresponding to the fourth test pattern, dots 151*a* and 151*c* of an odd row and dots 151*b* and 151*d* of an even row may partially overlap each other if the interval between the dots 151*a* and 151*c* of the odd row and the dots 151*b* and 151*d* of the even row is D2 which is smaller than the reference interval D1 as illustrated in FIG. 4B, i.e., if the timings of formation of the dots 151*b* and 151*d* of the even row are not exactly one line later than (i.e., are less than one line later) the timings of formation of the dots 151*a* and 151*c* of the odd row.

If the drive timings of the print head are changed, dots corresponding to the nozzles are printed at incorrect positions to cause some dots to partially overlap. Extending a test print range to print a plurality of test patterns causes a difference between a level of shade of a test pattern printed using original drive timings and a level of shade of a test pattern printed using the changed drive timings. That is, if the characteristics of the print head are changed to change drive timings thereof to print a test pattern, dots are printed at incorrect positions and some dots may even partially overlap. This will increase an area of blank portions on the print medium where no dot is printed, thereby increasing a level of brightness of the test pattern printed on the print medium.

Figure 5:
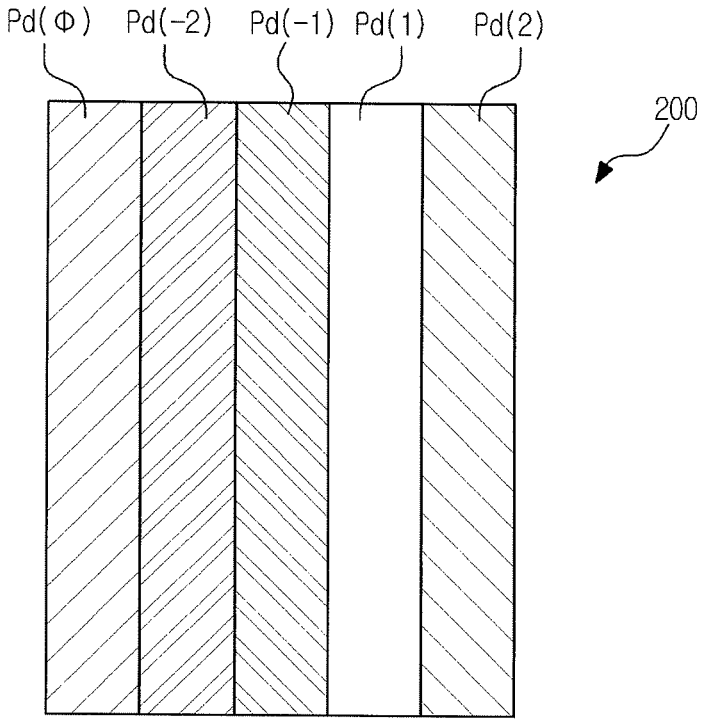
FIG. 5 illustrates an example where the first to fifth test patterns are printed with a print head such that the test patterns are arranged along a transverse direction of a sheet of paper according to an embodiment of the present general inventive concept.

A print pattern 200 illustrated in FIG. 5 is obtained by dividing a print range of a sheet of paper corresponding to one print head into five sections arranged along the transverse direction A of the sheet of paper and printing the first to fifth test patterns respectively on the five sections sequentially along the longitudinal direction of the sheet of paper for a specific period of time using the same drive timings. The user can recognize that the fourth test pattern Pd(1) is the brightest among the test patterns of the print pattern 200 if the fourth test pattern is the brightest on the printed sheet of paper.

Figure 6:
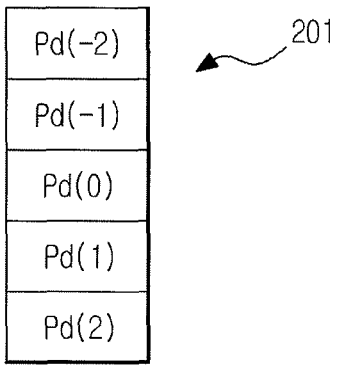
FIG. 6 illustrates an example where the first to fifth test patterns are printed with a print head sequentially along a longitudinal direction of a sheet of paper according to an embodiment of the present general inventive concept.
Figure 7:
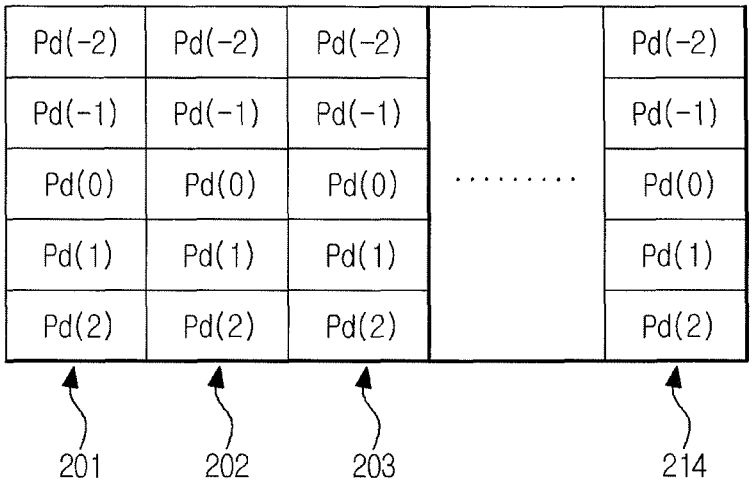
FIG. 7 illustrates an example where the first to fifth test patterns are printed with a plurality of print heads sequentially along a longitudinal direction of a sheet of paper according to an embodiment of the present general inventive concept.

A print pattern 201 illustrated in FIG. 6 is obtained by dividing a print range of a sheet of paper, corresponding to one print head, into five sections arranged along the conveyance direction of the sheet of paper and sequentially printing the first to fifth test patterns respectively on the five sections using the same drive timings. FIG. 7 illustrates an extension of the example of FIG. 6. A plurality of print patterns 201, 202, . . . 214 corresponding respectively to a plurality of print heads 150 can be printed as illustrated in FIG. 7 if the first to fifth test patterns are printed for each of a plurality of sections of the print range using the plurality of print heads 150.

Figure 8:
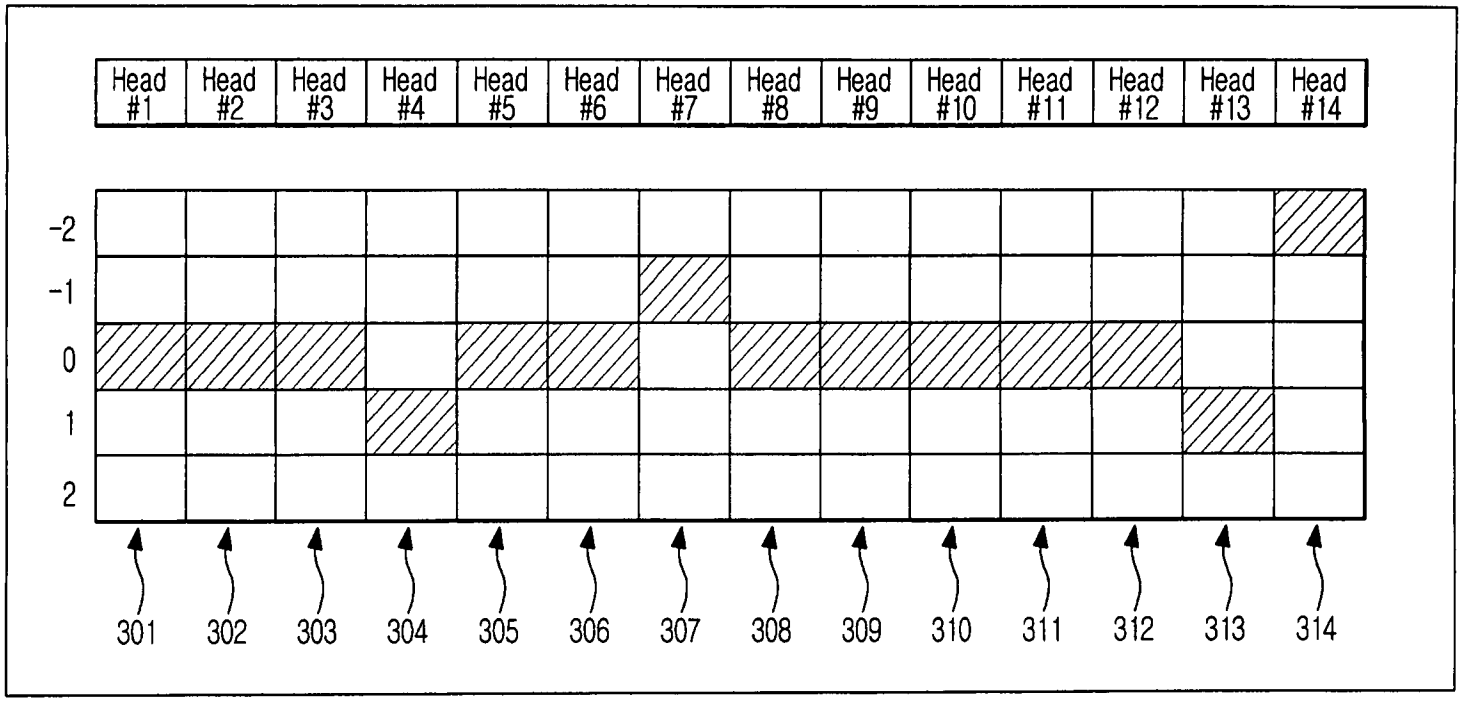
FIG. 8 illustrates the first to fifth test patterns printed with a plurality of print heads sequentially along a longitudinal direction of a sheet of paper according to an embodiment of the present general inventive concept, where a brightest test pattern of the test patterns printed with each print head is shaded.

The sequential printing of the plurality of test patterns for each of the plurality of print heads 150 in this manner allows the user to compare the characteristics of neighboring print heads (Head #1 to Head #14) as illustrated in FIG. 8.

In FIG. 8, numbers –2, –1, 0, 1, 2 written at a left side of the test patterns of the print head (Head #1) are pattern numbers to identify the test patterns and one can distinguish the brightest (shaded in FIG. 8) of the plurality of test patterns 301 to 314 for each of the print heads 150.

This embodiment employs a method in which the user views the printed result as illustrated in FIG. 8 to identify the brightest test pattern corresponding to each of the plurality of print heads 150. The present general inventive concept is not limited to this method and may also employ a method in which the test patterns 301 to 314 printed as illustrated in FIG. 8 are scanned by an all-in-one printer including a scanner function in addition to a printer function using a printing apparatus. The scanned image is analyzed to determine the brightest test pattern of each print head and thus to determine the drive timing of the test pattern.

FIG. 9 is an example screen 400 to allow the user to enter the pattern number of the brightest test pattern of each of the plurality of print heads 150 (FIG. 2) through the user interface 160 (FIG. 2).

Figure 10:
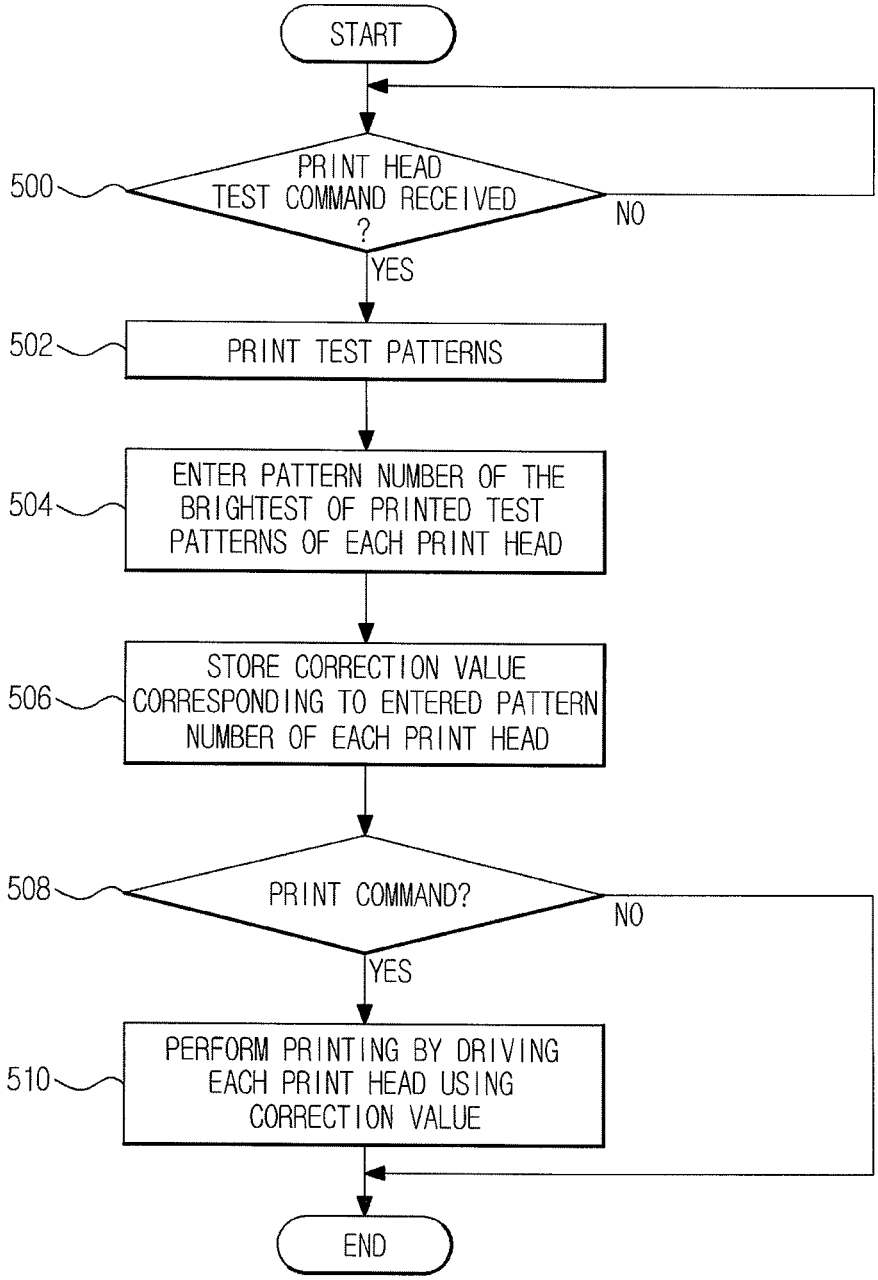
FIG. 10 is a flow chart illustrating a method to control an inkjet image forming apparatus according to an embodiment of the present general inventive concept.

Reference will now be made to a method to control an inkjet image forming apparatus according to an embodiment of the present general inventive concept with reference to FIGS. 2 and 10.

After power is supplied to the apparatus, the controller 170 determines whether a command to test the characteristics of print heads 150 has been received through the user interface 160 (operation 500).

If a determination is made that the test command has been received, the controller 170 prints the first to fifth test patterns for each of the plurality of print heads 150 using pattern information, used to determine the characteristics of each of the print heads 150, stored in the memory 180 (operation 502).

By viewing the printed result as illustrated in FIG. 8, the user identities the brightest test pattern corresponding to each of the plurality of print heads 150 and enters a pattern number to identify the brightest test pattern of each print head on a screen 400 provided by the user interface 160 as illustrated in FIG. 9 (operation 504).

The controller 170 stores correction values, corresponding to the respective pattern numbers of the brightest test patterns of the print heads 150 entered through the user interface 170, in the memory 180 (operation 506). The correction values are used to allow drive timings, applied to print the brightest test patterns corresponding to the entered pattern numbers, to be applied when normal printing is performed. Thus, the drive timing applied to each of the print heads 150 so as to print the brightest image may be different from each other.

The controller 170 determines whether a print command has been received through the user interface 160 (operation 508). If a determination is made that a print command has been received, the controller 170 performs printing by driving the plurality of print heads 150 using the correction values stored in the memory 180 (operation 510).

The present general inventive concept can also be embodied as computer-readable codes on a computer-readable medium. The computer-readable medium can include a computer-readable recording medium and a computer-readable transmission medium. The computer-readable recording medium is any data storage device that can store data that can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. The computer-readable transmission medium can transmit carrier waves or signals (e.g., wired or wireless data transmission through the Internet). Also, functional programs, codes, and code segments to accomplish the present general inventive concept can be easily construed by programmers skilled in the art to which the present general inventive concept pertains.

As is apparent from the above description, the present general inventive concept provides an inkjet image forming apparatus and a method to control the same with a variety of features and utilities. For example, a plurality of test patterns is printed for each print head and a drive timing corresponding to each print head can be corrected based on the printed result.

When the apparatus includes a plurality of print heads, the same test pattern is printed using the print heads. The user can easily and correctly identify characteristics of each print head based on brightness of the printed test pattern and can also input information of the characteristics of each print head through a user interface. The input information is stored to apply the input information to a normal print operation to maintain satisfactory characteristics of the print heads and to manage the characteristics of the print heads.

Although various embodiments of the present general inventive concept have been illustrated and described, it would be appreciated by those skilled in the art that changes may be made in these embodiments without departing from the principles and spirit of the general inventive concept, the scope of which is defined in the claims and their equivalents

What is claimed is:

1. An inkjet image forming apparatus, comprising:

a print head comprising nozzles disposed in pairs of rows that continuously extend across a length of the print head without deviation in a direction transverse to a print medium feeding direction, each pair of rows being configured to print a different color;

a memory to store control information of the print head; and a controller to obtain brightness level information of a print result printed using the control information and to correct the stored control information based on the obtained brightness level information, the stored control information to test a drive timing of the nozzles of each pair of rows.

2. The inkjet image forming apparatus according to claim 1, wherein the controller alternately drives the nozzles of the rows of each pair of rows to print each of the colors on a line by line basis.

3. The inkjet image forming apparatus according to claim 1, wherein the memory stores information used to correct the drive timing based on a test result of the nozzles of the print head.

4. The inkjet image forming apparatus according to claim 1, wherein the controller receives the brightness level information through a user interface.

5. An inkjet image forming apparatus, comprising:

print heads that each comprise nozzles disposed in pairs of rows that continuously extend across a length of the print heads without deviation in a direction transverse to a print medium feeding direction, each pair of rows being configured to print a different color; and a controller to apply a different nozzle drive timing to each of the print heads in order to form a line when at least one of the colors is printed on the print medium on a line by line basis, and the controller to apply a drive timing to provide a brightest printing to each of the plurality of print heads.

6. The inkjet image forming apparatus according to claim 5, further comprising:

a user interface to receive information of a drive timing providing the brightest printing for each of the print heads.

7. The inkjet image forming apparatus according to claim 6, wherein information identifying a brightest test pattern among test patterns printed by each of the print heads is received through the user interface.

8. An inkjet image forming apparatus, comprising:

print heads that each comprise nozzles disposed in pairs of rows that continuously extend across a length of the print heads without deviation in a direction transverse to a print medium feeding direction, each pair of rows being configured to print a different color;

a memory to store information of a drive timing of nozzles, corresponding to a time to jet ink, for each of the print heads; and a controller to control an operation of each of the print heads to print test patterns for each of the colors using the information stored in the memory, to receive information of a drive timing corresponding to a brightest one of the test patterns, and to apply the received drive timing information to a normal print operation, wherein, when the nozzles of the rows of each pair of rows are alternately driven, the information of the drive timing includes a difference between a time to drive the nozzles of each row.

9. The inkjet image forming apparatus according to claim 8, further comprising:

a user interface to provide information of a drive timing corresponding to the brightest test pattern.

10. An inkjet image forming apparatus having a test printing mode and a normal printing mode, the apparatus comprising:

one or more print heads to print test patterns in the test printing mode, each print head comprising nozzles disposed in pairs of rows that continuously extend across a length of each print head without deviation in a direction transverse to a print medium feeding direction, each pair of rows being configured to print a different color;

a memory to store a first set of information to be used to print the test patterns and a second set of information corresponding to a comparison of the test patterns; and a controller to control the one or more print heads to print the test patterns based on the first set of information and to apply the second set of information in the normal printing mode to correct a characteristic of the one or more print heads, the second set of information corresponding to a drive timing of at least one test pattern.

11. The apparatus of claim 10, wherein the second set of information comprises:

information based on a brightest test pattern.

* * * * *